US010511125B2

(12) United States Patent
Shindo

(10) Patent No.: US 10,511,125 B2
(45) Date of Patent: Dec. 17, 2019

(54) CONNECTOR HAVING A LEVER

(71) Applicant: Tyco Electronics Japan G.K., Kanagawa (JP)

(72) Inventor: Yoshihiko Shindo, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/689,673

(22) Filed: Aug. 29, 2017

(65) Prior Publication Data

US 2018/0062312 A1 Mar. 1, 2018

(30) Foreign Application Priority Data

Aug. 30, 2016 (JP) ..... 2016-168301

(51) Int. Cl.
*H01R 13/62* (2006.01)
*H01R 13/629* (2006.01)

(52) U.S. Cl.
CPC . *H01R 13/62955* (2013.01); *H01R 13/62938* (2013.01); *H01R 13/62944* (2013.01)

(58) Field of Classification Search
CPC ..... H01R 13/62955; H01R 13/62938
USPC ..... 439/310
See application file for complete search history.

(56) References Cited

U.S. PATENT DOCUMENTS 5,629,627 A * 5/1997 Hoshino ..... G01R 31/045 324/538
6,863,463 B2 * 3/2005 Matsushita ..... F16B 21/10 403/322.4
6,929,403 B1 * 8/2005 Arciniegas ..... G02B 6/4201 385/55
7,025,610 B2 * 4/2006 Demuth ..... H01R 13/62944 439/157
7,137,835 B2 * 11/2006 Shiga ..... H01R 13/62938 439/157
7,175,451 B2 * 2/2007 Shuey ..... H01R 13/62955 439/157
7,179,132 B2 * 2/2007 Flowers ..... H01R 13/4364 439/686
7,234,952 B2 * 6/2007 Sasaki ..... H01R 13/6295 439/157
7,396,240 B2 * 7/2008 Frederiksen ..... H01R 13/639 439/157
8,246,365 B2 * 8/2012 Shishikura ..... H01R 13/62955 439/157

(Continued)

FOREIGN PATENT DOCUMENTS

EP 2284960 A1 2/2011
JP 2008146847 A 6/2008

(Continued)

OTHER PUBLICATIONS

French Written Opinion, dated Aug. 23, 2017, 5 pages.

*Primary Examiner* — Abdullah A Riyami
*Assistant Examiner* — Vladimir Imas
(74) *Attorney, Agent, or Firm* — Barley Snyder

(57) ABSTRACT

A connector comprises a wire cover and a lever pivotally attached to the wire cover. The wire cover has a cover lock and a cover biasing member. The lever is rotatable between an unmated position and a mated position. When the lever is in the mated position, the cover lock locks the lever in the mated position and the cover biasing member biases the lever toward the unmated position.

17 Claims, 5 Drawing Sheets

(56) References Cited

U.S. PATENT DOCUMENTS

| | | | | |
|---|---|---|---|---|
| 9,048,579 | B2 * | 6/2015 | Itou | H01R 13/62944 |
| 9,293,860 | B1 * | 3/2016 | Kim | H01R 13/62927 |
| 9,768,550 | B2 * | 9/2017 | Goletto | H01R 13/62933 |
| 9,865,961 | B2 * | 1/2018 | Shibaya | H01R 13/516 |
| 2004/0192090 | A1 * | 9/2004 | Flowers | H01R 13/5812<br>439/157 |
| 2005/0026484 | A1 | 2/2005 | Demuth | |

FOREIGN PATENT DOCUMENTS

| | | | |
|---|---|---|---|
| JP | 2009266383 | A | 11/2009 |
| JP | 201326154 | A | 2/2013 |
| JP | 3187380 | U | 10/2013 |

* cited by examiner

CONNECTOR HAVING A LEVER

CROSS-REFERENCE TO RELATED APPLICATION

This application claims the benefit of the filing date under 35 U.S.C. § 119(a)-(d) of Japanese Patent Application No. 2016-168301, filed on Aug. 30, 2016.

FIELD OF THE INVENTION

The present invention relates to an electrical connector and, more particularly, to an electrical connector having a lever and mating with a mating connector by moving the lever.

BACKGROUND

In known connectors having a lever, mating with a mating connector is started in a state in which the lever is rotated to an unmated position. The connector is then inserted into the mating connector and the lever is rotated to a mated position in which the mating connector is mated with the connector. The rotation of the lever draws the mating connector into the mated position with the connector.

In known connectors having the lever, a lock is provided so as to maintain the mated position of the lever. The connector further has a stopper preventing the lever from rotating past the mated position; the lever abuts the stopper when the lever slightly passes through a position at which the lever is locked by the lock. A slight play is provided between the lock and the stopper. When the connector is used in an application subject to vibration, the lever located at the mated position rattles between the lock and the stopper, leading to the creation of abnormal noise.

In Japanese Patent Application No. 2013-26154A, a connector having a lever is disclosed which has a structure suppressing the creation of noise by suppressing the aforementioned rattling. The connector of JP 2013-26154A has an elastic arm disposed at the lock. The rattling of the lever is suppressed by a force imparted by elastic deformation of the elastic arm pressing the lever toward the unmated position. In the structure disclosed in JP 2013-26154A, however, the reaction force from the elastic arm is large in order to reliably suppress the rattling of the lever. When the mated mating connector must be unmated from the disclosed connector, and the locked lever unlocked from the locked state, the reaction force from the elastic arm is increased and a stronger force for unlocking the lever is required. Connectors known in the prior art do not adequately balance the secure suppression of the rattling and an appropriate force required for unlocking the lever.

SUMMARY

A connector according to the invention comprises a wire cover and a lever pivotally attached to the wire cover. The wire cover has a cover lock and a cover biasing member. The lever is rotatable between an unmated position and a mated position. When the lever is in the mated position, the cover lock locks the lever in the mated position and the cover biasing member biases the lever toward the unmated position.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
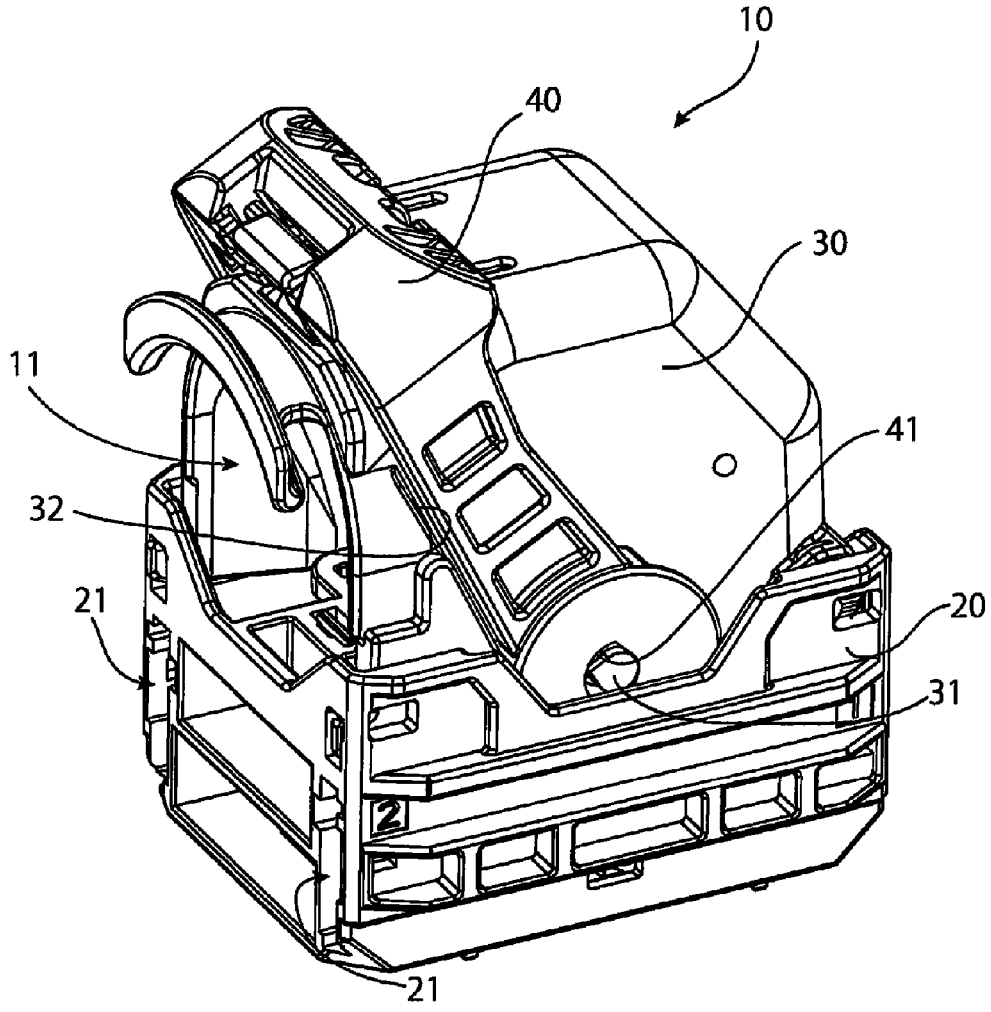
FIG. 1 is a perspective view of a connector according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A connector 10 according to the invention is shown in FIG. 1. The connector 10 includes a housing 20, a wire cover 30, and a lever 40. The major components of the invention will now be described in greater detail.

The wire cover 30, as shown in FIG. 1, has a dome shape which largely opens downward toward the housing 20 and bulges upward. An opening 11 through which a plurality of wires (not shown) extend is formed between the wire cover 30 and the housing 20. End portions of the wires enter the opening 11 and are connected to a plurality of contacts (not shown) supported by the housing 20.

Figure 2:
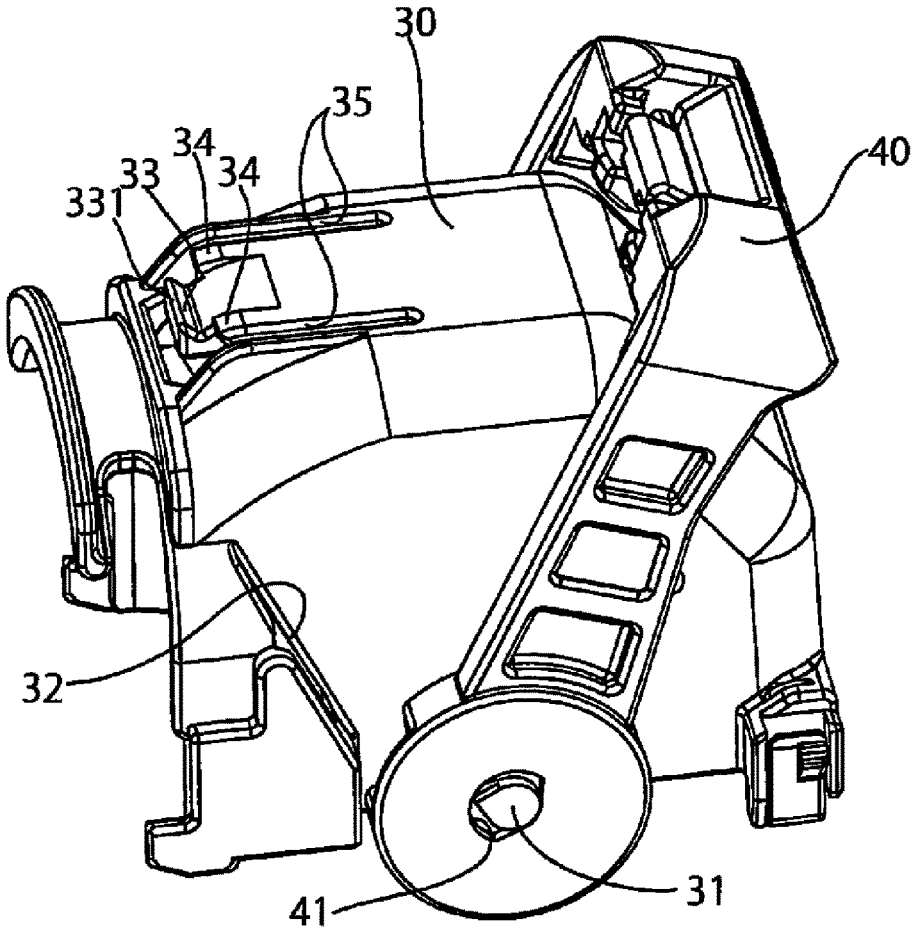
FIG. 2 is a perspective view of a wire cover and a lever of the connector.

The wire cover 30, as shown in FIGS. 1 and 2, has a pair of stoppers 32, a cover biasing member 33, and a pair of cover locks 34. The stoppers 32 are disposed on both side faces of the wire cover 30. The cover biasing member 33 is disposed at a central portion of the wire cover 30 in a widthwise direction and the cover locks 34 are disposed on both sides of the cover biasing member 33 in the widthwise direction of the wire cover 30. The cover biasing member 33 and the cover locks 34 are further disposed at a distal end portion of the wire cover 30 between a pair of slots 35 located on both sides of the wire cover 30; the cover biasing member 33 and the cover locks 34 form an integral cantilever. The cover biasing member 33 extends longer than the cover locks 34. A leading edge portion of the cover biasing member 33 at the distal end has a projection 331 projecting upward.

The lever 40, as shown in FIGS. 1 and 2, extends in a substantially inverse U-shape so as to straddle the wire cover 30 in a widthwise direction of the wire cover 30. Passageways 41 are disposed at opposite end portions of the lever 40. The wire cover 30 has a pair of projections 31 at opposite side faces of the wire cover 30, the projections 31 extending into the passageways 41 at the both end portions of the lever 40. The lever 40 is rotated about the projections 31 between a mated position shown in FIG. 1 and an unmated position shown in FIG. 2.

Figure 3:
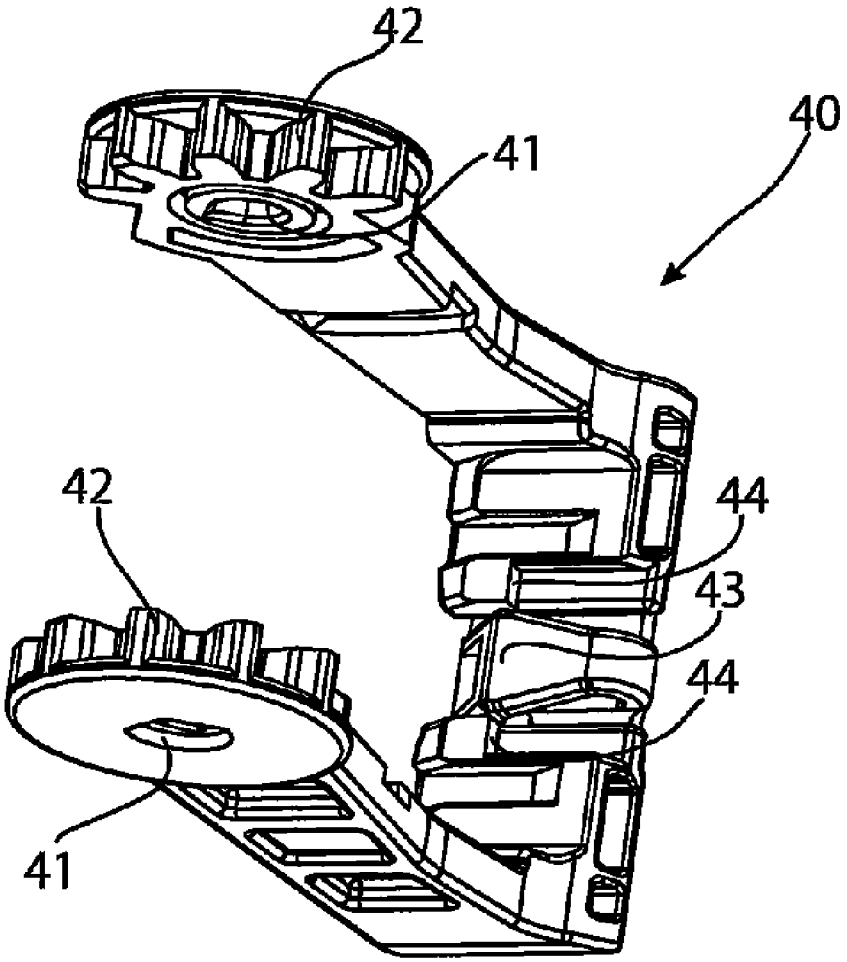
FIG. 3 is a perspective view of the lever.

The lever 40, as shown in FIG. 3, has a pinion gear 42 extending about each of the passageways 41. The pinion gears 42 mesh with racks (not shown) provided on plate-shape sliders (not shown). The sliders are inserted into slits 21 on both sides of the housing 20, shown in FIG. 1, and are not exposed on an exterior of the connector 10.

The lever 40, as shown in FIG. 3, has a lever biasing member 43 and a pair of lever locks 44. The lever biasing member 43 is disposed at a central portion of an arm portion of the lever 40 and extends as a cantilever in the widthwise direction of the wire cover 30. The lever locks 44 are disposed at both sides of the lever biasing member 43.

The mating of the connector 10 and the locking of the lever 40 to the wire cover 30 will now be described in greater detail with reference to FIGS. 4A-5B.

Figure 4A:
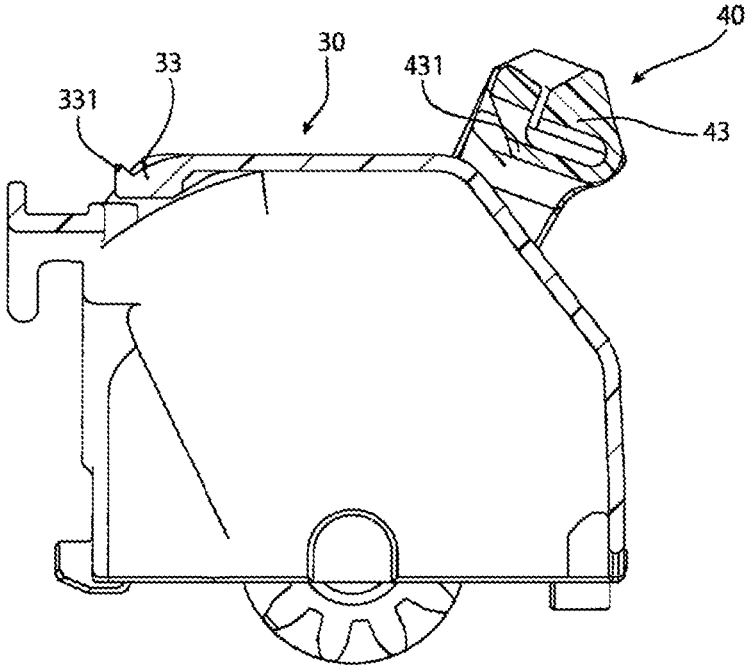
FIG. 4A is a sectional view of the wire cover and the lever taken through a biasing member with the lever in an unmated position.
Figure 4B:
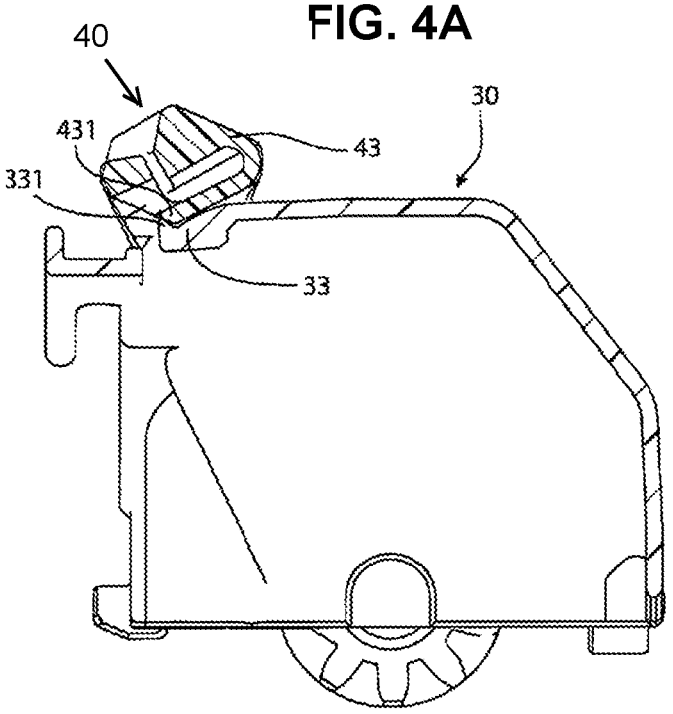
FIG. 4B is a sectional view of the wire cover and the lever taken through the biasing member with the lever in a mated position.
Figure 5A:
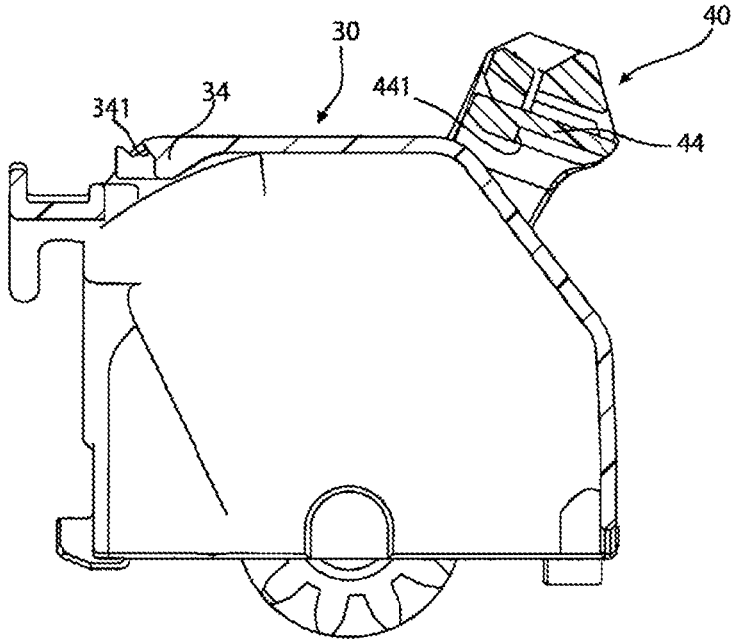
FIG. 5A is a sectional view of the wire cover and the lever taken through a lock with the lever in the unmated position.
Figure 5B:
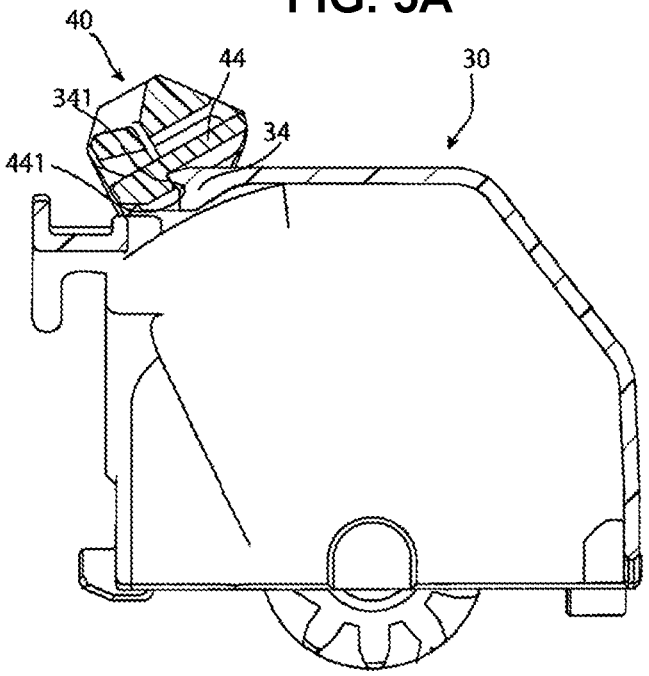
FIG. 5B is a sectional view of the wire cover and the lever taken through the lock with the lever in the mated position.

When the lever 40 is in the mated position shown in FIGS. 1, 4B, and 5B, the connector 10 is mated with a mating connector (not shown). When the lever 40 is in the unmated position shown in FIGS. 2, 4A, and 5A, the connector 10 is not mated with the mating connector. In mating with the mating connector, the lever 40 is first turned to the unmated position. Then, the mating connector is arranged at an initial position for mating such that a plurality of cam followers (not shown) of the mating connector are allocated to inlet portions of a plurality of cam grooves (not shown) provided in the sliders connected to the lever 40. The lever 40 is turned from the unmated position to the mated position and the sliders formed with the racks are slid according to rotation of the pinion gears 42 of the lever 40 during the turning of the lever 40. The cam followers of the mating connector are pulled deeper into the cam grooves of the sliders and the mating connector thus mates with the connector 10.

As shown in FIG. 4B, when the lever 40 is rotated to the mated position, a portion 431 close to a distal end of the lever biasing member 43 abuts on the projection 331 of the cover biasing member 33. Thereby, the cover biasing member 34 is pressed to elastically deform by the lever biasing member 43; in the mated position, the lever 40 is biased toward the unmated position by a reaction force due to elastic deformation of the cover biasing member 33.

As shown in FIGS. 5A and 5B, the cover locks 34 each have a cover hook 341 and the lever locks 44 each have a lever hook 441. When the lever 40 is rotated to a position just before the mated position, the cover hook 341 is pressed down by the lever hook 441 so that the cover lock 34 is elastically deformed. Then, when the lever 40 is fully rotated to the mated position shown in FIG. 5B, the cover lock 34 returns from the elastic deformation and the cover hook 341 and the lever hook 441 engage each other. The lever 40 is thereby locked at the mated position.

The lever 40, as shown in FIG. 1, would abut the stoppers 32 when turned to the mated position; the stoppers 32 prevent the lever 40 from rotating too far beyond the mated position. The stoppers 32 are provided at positions in which the lever 40 would abut the stoppers 32 when the lever 40 has been rotated slightly past a position at which the lever 40 is locked by the locks 34, 44. The lever 40 has a play between the position at which the lever 40 has been locked by the locks 34, 44 and the position at which the lever 40 abuts the stoppers 32. The lever 40 located at the mated position is biased toward the unmated position by the lever biasing member 43 pressed by the cover biasing member 33, as described above with respect to FIGS. 4A and 4B. Therefore, even when the connector 10 is subject to vibration, the lever hook 441 is always pressed on the cover hook 341. The lever 40 is maintained at a position at which it is always spaced from the stoppers 32, so that abnormal noise generated due to the lever 40 abutting on the stoppers 32 is prevented from occurring. Further, the locks 34, 44 and the biasing members 33, 43 are provided at positions different from each other in the widthwise direction of the connector 10, and consequently, the biasing members 33, 43 suppressing the rattling do not affect the locks 34, 44.

In the embodiment described above, the wire cover 30 supports the lever 40. In other embodiments, other structure could support the lever 40; in a connector which does not include the wire cover, for example, the lever could be pivotally mounted to the housing 20, and the biasing member 33, 43 and the lock 34, 44 formed on the housing 20.

What is claimed is:

1. A connector, comprising:

a wire cover having a cover lock and a cover biasing member, the cover biasing member having a leading edge portion at a distal end and a projection projecting upward; and a lever pivotally attached to the wire cover and rotatable between an unmated position and a mated position having a lever hook and a lever biasing member, the lever biasing member having a portion close to a distal end thereof, when the lever is in the mated position, the portion abuts on the projection and the lever hook engages with the cover lock and the cover lock locking the lever in the mated position and the cover biasing member biasing the lever toward the unmated position when the lever is in the mated position.

2. The connector of claim 1, wherein the cover lock and the cover biasing member are disposed at different positions in a widthwise direction of the wire cover.

3. The connector of claim 2, wherein the wire cover has a pair of cover locks.

4. The connector of claim 3, wherein the cover biasing member is disposed between the cover locks in the widthwise direction of the wire cover.

5. The connector of claim 4, wherein the cover biasing member and cover locks form an integral cantilever extending from the wire cover.

6. The connector of claim 4, wherein, in the mated position, the cover biasing member is pressed and elastically deformed by a lever biasing member disposed on the lever.

7. The connector of claim 6, wherein, in the mated position, the cover locks engage and lock to a pair of lever locks disposed on the lever.

8. The connector of claim 7, wherein the lever locks and the lever biasing member are disposed at different positions in the widthwise direction of the wire cover.

9. The connector of claim 8, wherein the lever biasing member is disposed between the lever locks in the widthwise direction of the wire cover.

10. The connector of claim 1, wherein the wire cover has a stopper disposed on a side face of the wire cover.

11. The connector of claim 10, wherein the lever abuts the stopper in a position of rotation beyond the mated position.

12. The connector of claim 11, wherein the cover biasing member prevents the lever from rotating beyond the mated position and abutting the stopper.

13. The connector of claim 1, wherein the lever is formed in a substantially inverse U-shape and straddles the wire cover in a widthwise direction of the wire cover.

14. The connector of claim 13, wherein each of a pair of opposite end portions of the lever is pivotally attached to the wire cover.

15. The connector of claim 1, wherein, in the unmated position, the connector is not mated with a mating connector, and in the mated position, the connector is mated with the mating connector.

16. The connector of claim 1, further comprising a housing, the wire cover disposed on the housing.

17. The connector of claim 16, wherein the wire cover and the housing define an opening through which a plurality of wires extend.

* * * * *